US009567659B2

(12) United States Patent
Somani et al.

(10) Patent No.: US 9,567,659 B2
(45) Date of Patent: Feb. 14, 2017

(54) METHOD FOR MANUFACTURING A HIGH-STRENGTH STRUCTURAL STEEL AND A HIGH-STRENGTH STRUCTURAL STEEL PRODUCT

(75) Inventors: Mahesh Chandra Somani, Oulu (FI); David Arthur Porter, Oulu (FI); Leo Pentti Karjalainen, Oulu (FI); Tero Tapio Rasmus, Siikajoki (FI); Ari Mikael Hirvi, Oulu (FI)

(73) Assignee: RAUTARUUKKI OYJ, Helsinki (FI)

( * ) Notice: Subject to any disclaimer, the term of this patent is extended or adjusted under 35 U.S.C. 154(b) by 474 days.

(21) Appl. No.: 14/130,426

(22) PCT Filed: Jul. 2, 2012

(86) PCT No.: PCT/FI2012/050698

§ 371 (c)(1),
(2), (4) Date: Apr. 3, 2014

(87) PCT Pub. No.: WO2013/004910

PCT Pub. Date: Jan. 10, 2013

(65) Prior Publication Data

US 2014/0299237 A1 Oct. 9, 2014

(30) Foreign Application Priority Data

Jul. 1, 2011 (FI) ..... 20115702

(51) Int. Cl.
*C21D 1/18* (2006.01)
*C21D 8/02* (2006.01)
(Continued)

(52) U.S. Cl.
CPC ..... *C22C 38/58* (2013.01); *C21D 1/18* (2013.01); *C21D 8/005* (2013.01); *C21D 8/02* (2013.01);
(Continued)

(58) Field of Classification Search
CPC ..... C21D 1/18; C21D 2211/001; C21D 2211/008; C21D 8/005; C21D 8/02; C21D 8/0226; C21D 8/0263; C22C 38/00; C22C 38/02; C22C 38/04; C22C 38/06; C22C 38/18; C22C 38/34; C22C 38/42; C22C 38/44; C22C 38/46; C22C 38/48; C22C 38/58
(Continued)

(56) References Cited

U.S. PATENT DOCUMENTS 3,254,991 A 6/1966 Shimmin et al.
4,671,827 A 6/1987 Thomas et al.
(Continued)

FOREIGN PATENT DOCUMENTS

CN 1306582 8/2001
CN 101805821 8/2010
(Continued)

OTHER PUBLICATIONS

International Search Report prepared by the European Patent Office on Oct. 29, 2012, for International Application No. PCT/FI2012/050698.
(Continued)

*Primary Examiner* — Helene Klemanski
(74) *Attorney, Agent, or Firm* — Sheridan Ross P.C.

(57) ABSTRACT

The invention relates to a method for manufacturing a high-strength structural steel and to a high-strength structural steel product. The method comprises a providing step for providing a steel slab, a heating step (1) for heating said steel slab to 950 to 1300 C, a temperature equalizing step (2) for equalizing the temperature of the steel slab, a hot rolling step including a hot rolling stage of type I (5) for hot rolling the steel slab in the no-recrystallization temperature range below the recrystallization stop temperature (RST) but
(Continued)

above the ferrite formation temperature A3, a quenching step (6) for quenching said hot-rolled steel at cooling rate of at least 20 C/s to a quenching-stop temperature (QT) between Ms and $M_f$ temperatures, a partitioning treatment step (7, 9) for partitioning said hot-rolled steel in order to transfer carbon from martensite to austenite, and a cooling step (8) for cooling said hot-rolled steel to room temperature.

39 Claims, 5 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/58*** | (2006.01) |
| ***C21D 9/46*** | (2006.01) |
| ***C21D 8/00*** | (2006.01) |

(52) U.S. Cl.
CPC ..... *C21D 8/0226* (2013.01); *C21D 8/0263* (2013.01); *C21D 9/46* (2013.01); *C22C 38/00* (2013.01); *C22C 38/02* (2013.01); *C22C 38/04* (2013.01); *C22C 38/06* (2013.01); *C22C 38/18* (2013.01); *C22C 38/34* (2013.01); *C22C 38/42* (2013.01); *C22C 38/44* (2013.01); *C22C 38/46* (2013.01); *C22C 38/48* (2013.01); *C21D 2211/001* (2013.01); *C21D 2211/008* (2013.01)

(58) Field of Classification Search
USPC ..... 148/602, 645, 332, 333, 335; 420/90, 420/103, 104, 112, 117
See application file for complete search history.

(56) References Cited

U.S. PATENT DOCUMENTS

| | | | | | |
|---|---|---|---|---|---|
| 5,531,842 | A * | 7/1996 | Koo | C21D 8/0226 | 148/653 |
| 5,545,270 | A * | 8/1996 | Koo | C21D 8/0226 | 148/593 |
| 5,653,826 | A * | 8/1997 | Koo | C21D 8/0226 | 148/328 |
| 5,900,075 | A * | 5/1999 | Koo | C21D 8/0226 | 148/335 |
| 6,159,312 | A * | 12/2000 | Koo | C22C 38/04 | 148/336 |
| 6,245,290 | B1 * | 6/2001 | Koo | C21D 8/0226 | 148/335 |
| 6,248,191 | B1 * | 6/2001 | Luton | C21D 8/0226 | 148/653 |
| 6,254,698 | B1 * | 7/2001 | Koo | C21D 8/02 | 148/332 |
| 6,827,797 | B2 * | 12/2004 | Kusinski | C22C 38/18 | 148/660 |
| 7,118,637 | B2 * | 10/2006 | Kusinski | C22C 38/58 | 148/333 |
| 7,754,031 | B2 * | 7/2010 | Beguinot | C21D 1/18 | 148/333 |
| 2006/0011274 | A1 * | 1/2006 | Speer | C21D 1/18 | 148/664 |
| 2013/0037181 | A1 * | 2/2013 | Jin | C21D 8/0205 | 148/628 |

FOREIGN PATENT DOCUMENTS

| | | |
|---|---|---|
| WO | WO 98/38345 A1 | 9/1998 |
| WO | WO 99/05328 A1 | 9/1999 |
| WO | WO 00/37689 A1 | 6/2000 |

OTHER PUBLICATIONS

Search Report prepared by the Finnish Patent Office on Mar. 12, 2012, for Finnish Application No. 20115702.
Official Action (English translation) for Chinese Patent Application No. 2012800394430, dated Nov. 19, 2014, 11 pages.

* cited by examiner

METHOD FOR MANUFACTURING A HIGH-STRENGTH STRUCTURAL STEEL AND A HIGH-STRENGTH STRUCTURAL STEEL PRODUCT

CROSS REFERENCE TO RELATED APPLICATIONS

This application is a national stage application under 35 U.S.C. 371 and claims the benefit of PCT Application No. PCT/FI2012/050698 having an international filing date of 2 Jul. 2012, which designated the United States, which PCT application claimed the benefit of Finland Application No. 20115702 filed 1 Jul. 2011, the disclosure of each of which are incorporated herein by reference.

The invention disclosed in this patent application has been made by inventors Mahesh Chandra Somani, David Arthur Porter, Leo Pentti Karjalainen, at University of Oulu, and by Tero Tapio Rasmus and An Mikael Hirvi at Rautaruukki Oyj. The invention has been transferred to the assignee, Rautaruukki Oyj, by a separate agreement made between the parties.

FIELD OF INVENTION

The invention relates to a method for manufacturing a high-strength structural steel and to a high-strength structural steel product. Especially the invention relates to Q&P (Quenching & Partitioning) method applied in a hot rolling mill and to a high-strength, ductile, tough structural steel product having an essentially martensitic microstructure with small fractions of finely divided retained austenite.

BACKGROUND OF THE INVENTION

Conventionally, quenching and tempering is used to obtain high-strength structural steels with good impact toughness and elongation. However, tempering is additional process step requiring time and energy because of re-heating from temperatures below $M_f$ after quenching.

In recent years, sophisticated high strength steels with improved toughness are achieved advantageously by direct quenching. However, the ductility of these steels in terms of their elongation or reduction of area to fracture in uniaxial tensile testing is generally acceptable, but their uniform elongation, i.e. work hardening capacity could be improved. This deficiency is an important factor limiting the wider and more demanding application of such steels because strain localization during fabrication or as a result of overloading in the final application can be detrimental to the integrity of the structure.

Due to an ever-increasing demand for advanced high-strength steels (AHSS) with excellent toughness and reasonable ductility and weldability, fresh efforts have been directed to develop new compositions and/or processes to meet the challenges of the industry. Within this category, the dual-phase (DP), complex phase (CP), transformation induced plasticity (TRIP) and twinning induced plasticity (TWIP) steels have been developed during the past few decades, mainly to meet the requirements of the automotive industry. The main aims have been to save energy and raw materials, improve safety standards and protect the environment. So far, the yield strength of the above AHSS steels with carbon content in the range of 0.05 to 0.2 wt. % has been usually restricted to about 500 to 1000 MPa.

Patent publication US2006/0011274 A1 discloses a relatively new process called quenching and partitioning (Q&P) which enables the production of steels with microstructures containing retained austenite. This known quenching and partitioning process consists of a two-step heat treatment. After reheating in order to obtain either a partially or fully austenitic microstructure, the steel is quenched to a suitable predetermined temperature between the martensite start ($M_s$) and finish ($M_f$) temperatures. The desired microstructure at this quench temperature (QT) consists of ferrite, martensite and untransformed austenite or martensite and untransformed austenite. In a second partitioning treatment step, the steel is either held at the QT or brought to a higher temperature, the so-called partitioning temperature (PT), i.e., PT≥QT. The aim of the later step is to enrich the untransformed austenite with carbon through depletion of the carbon-supersaturated martensite. In the Q&P process, formation of iron carbides or bainite is intentionally suppressed, and the retained austenite is stabilized to get the advantage of strain-induced transformation during subsequent forming operations.

The above developments were intended to improve the mechanical and forming related properties of thin sheet steels to be used in automotive applications. In such applications, good impact toughness is not required and yield strengths are limited to below 1000 MPa.

The target of this invention is to accomplish, preferably without additional heating from temperatures below $M_f$ after quenching, a structural steel product having a yield strength $R_{p0.2}$ of at least 960 MPa and excellent impact toughness, such as 27J Charpy V transition temperature ≤−50° C., preferably ≤−80° C. together with good total uniform elongation.

However, even though the best practice is to utilize the invention within the field of structural steels, it should be understood, that the referred method and steel product according to the invention can also be used as a method for manufacturing hot-rolled wear resistant steels and that the referred high-strength structural steel product can be used as hot-rolled wear resistant steels, even though such good impact toughness and ductility is not always required in wear resistant steel applications.

SHORT DESCRIPTION OF THE INVENTION

In the method, a steel slab, ingot or billet (hereafter referred to simply as a steel slab) is heated in a heating step to a specified temperature and then thermomechanically rolled in a hot rolling step. The thermomechanical rolling includes a hot rolling stage of type I for hot rolling the steel slab in a temperature range below the recrystallization stop temperature (RST) and above the ferrite formation temperature $A_3$. If the heating step for heating the steel slab includes heating to a temperature in the range 1000 to 1300° C., the thermomechanical rolling includes additionally a hot rolling stage of type II for hot rolling the steel slab in the static recrystallization domain above the recrystallization limit temperature (RLT), which hot rolling stage of type II is performed prior to the hot rolling stage of type I for hot rolling the steel slab in the temperature range below the recrystallization stop temperature (RST) and above the ferrite formation temperature $A_3$. In the case of the heating step being performed in lower heating temperatures, such as 950° C., the smaller resultant initial austenite grain size precludes the need for the hot rolling stage of type II that is performed above the recrystallization limit temperature (RLT), and consequently most of the hot rolling can take place below the recrystallization stop temperature (RST).

The accumulated strain below the recrystallization stop temperature (RST) is preferably at least 0.4. Subsequent to this thermomechanical rolling i.e. the hot rolling step, the hot-rolled steel is direct quenched in a quenching step to a temperature between $M_s$ and $M_f$ temperatures to achieve desired martensite-austenite fractions and subsequently the hot-rolled steel is held at a quenching-stop temperature (QT), slowly cooled from QT or even heated to a partitioning temperature PT>QT to increase the stability of the austenite by performing a partitioning treatment step for partitioning of carbon from the supersaturated martensite into the austenite. Following carbon partitioning treatment i.e. the partitioning treatment step, a cooling step for cooling the hot-rolled steel to room temperature is performed. During the cooling step some of the austenite may transform to martensite, but some austenite remains stable at room temperature or lower. Unlike in the case of tempering, the formation of iron carbides and the decomposition of austenite are intentionally suppressed during partitioning treatment by suitably choosing the chemical composition of the steel, mainly by using a high silicon content together with or without aluminum in such content which could provide such effect.

The method for providing a structural steel having high-strength and high impact toughness requires controlling of austenite state, i.e. grain size and shape, and dislocation density, prior to quenching, which means preferably deformation both in the recrystallization regime and in the no-recrystallization regime followed by DQ&P processing (Direct Quenching & Partitioning). The thermomechanical rolling followed by direct quenching results in the formation of fine packets and blocks of fine martensitic laths, shortened and randomized in different directions. Such a microstructure enhances the strength. It also enhances impact and fracture toughness by making crack propagation more tortuous. Further, the partitioning treatment increases the stability of the austenite existing after cooling to QT thereby leading to the presence of retained austenite at room temperature and lower temperatures.

The retained austenite is, however, partially metastable and transforms partially to martensite during plastic deformation as occurs in intentional straining of the steel, tensile testing of the steel, or overloading of the steel structure in the final application. This austenite transformation to martensite increases the work hardening rate and the uniform elongation of the steel product helping to prevent strain localization and premature structural failure by ductile fracture. Together with the fine, shortened and randomized martensite laths, thin films of retained austenite improve the impact and fracture toughness.

The advantage of rolling stage of type I resulting in strained prior austenite grains (PAG) is finer distribution of austenite during subsequent quenching to QT. When this kind of austenite is further stabilized by partitioning, improved combination of mechanical properties is achieved, particularly in respect of total uniform elongation and impact toughness.

Thus the method according to the invention provides a high-strength structural steel having improved combination of impact toughness, preferably also fracture toughness, and total uniform elongation. The structural steel product according to the invention can be used in wider applications in which impact and fracture toughness are essential and/or better deformation capacity without ductile fracture is required. The use of high-strength steel means that lighter-weight structures can be made.

The invented method has been named as TMR-DQP, i.e. thermomechanical rolling followed by direct quenching & partitioning.

Figure 1:
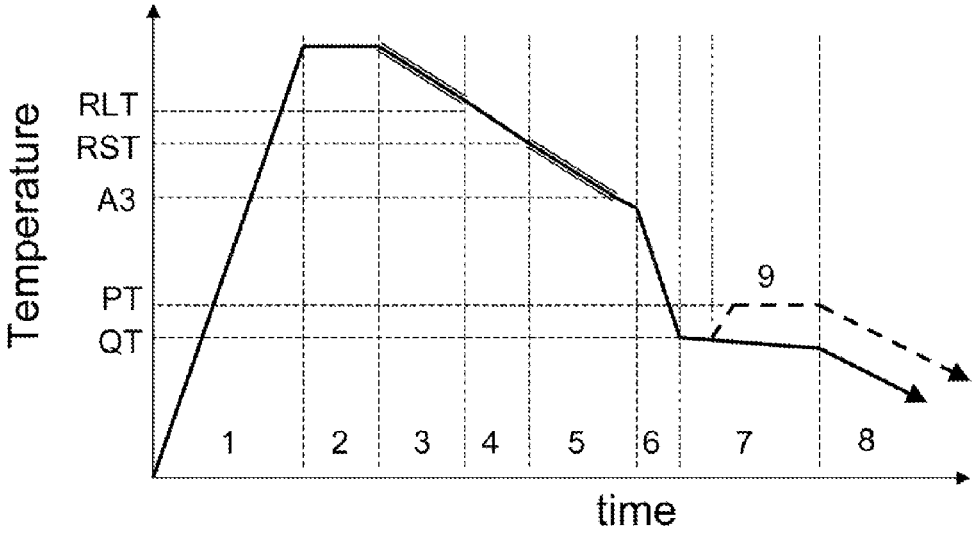
FIG. 1 depicts a temperature-time curve according to the embodiments of the invention.

DESCRIPTION OF ABBREVIATIONS AND SYMBOLS $\epsilon$ True strain
$\epsilon_1$, $\epsilon_2$, $\epsilon_3$ Principal plastic true strains in three principal perpendicular directions
$\epsilon_{eq}$ Equivalent plastic true strain
$\epsilon'$ Constant true strain rate
A Total elongation
AC Air cool
AF Alloy factor
$A_g$ Plastic uniform elongation
$A_{gt}$ Total uniform elongation
$A_3$ Temperature below which austenite becomes supersaturated with respect to ferrite
CEV Carbon equivalent
CP Complex phase
CS Coiling simulation
DI Ideal critical diameter
DP Dual-phase
DQ&P Direct quenching and partitioning
EBSD Electron back scatter diffraction
FRT Finish rolling temperature
GAR Grain aspect ratio
h Length of a volume element after plastic strain
H Length of a volume element before plastic strain
$M_f$ Martensite finish temperature
$M_s$ Martensite start temperature
PAG Prior austenite grain
PT Partitioning temperature (if partitioning treatment achieved at a temperature greater than QT).
Q&P Quenching and partitioning
QT Quench stop or quenching temperature
RLT Recrystallization limit temperature
$R_m$ Ultimate tensile strength $R_{p0.2}$ 0.2% yield strength
$R_{p0.1}$ 1.0% proof strength
RST Recrystallization stop temperature
RT Room temperature
SEM Scanning electron microscopy
t Time
T27J Temperature corresponding to 27J impact energy
T50% Temperature corresponding to 50% shear fracture
TEM Transmission electron microscopy
TMR Thermomechanical rolling
TMR-DQP Thermomechanical rolling followed by direct quenching and partitioning
TRIP Transformation induced plasticity
TWIP Twinning induced plasticity
XRD X-Ray diffraction
Z Reduction of area

LIST OF REFERENCE NUMERALS AND EXPLANATION

1 Heating step
2 Temperature equalizing step
3 Hot rolling stage of type II in the recrystallization temperature range
4 Waiting period for temperature to drop below the RST
5 Hot rolling step of type I in the no-recrystallization temperature range
6 Quenching step
7 Partitioning treatment step
8 Cooling step
9 Alternative partitioning treatment step
10 Retained austenite
11 Martensite

DETAILED DESCRIPTION OF THE INVENTION

The method for manufacturing a high-strength structural steel according to one embodiment comprises the following steps:

- A providing step for providing a steel slab (not shown in the figures),
- A heating step 1 for heating the steel slab to a temperature in the range 950 to 1300° C.,
- A temperature equalizing step 2 for equalizing the temperature of the steel slab,
- A hot rolling step including a hot rolling stage of type I 5 for hot rolling the steel slab in the no-recrystallization temperature range below RST but above ferrite formation temperature $A_3$,
- A quenching step 6 for quenching the hot-rolled steel at cooling rate of at least 20° C/s to the quenching-stop temperature (QT), which said quenching-stop temperature (QT) is between Ms and Mf temperatures,
- A partitioning treatment step 7, 9 for partitioning the hot-rolled steel in order to transfer carbon from martensite to austenite, and
- A cooling step 8 for cooling said hot-rolled steel to room temperature by forced or natural cooling.

The method comprises a heating step 1 for heating the steel slab to a temperature in the range 950 to 1300° C. in order to have completely austenitic microstructure.

The heating step 1 is followed by a temperature equalizing step 2 allowing all parts of the slab to reach essentially the same temperature level.

If the heating step 1 for heating the steel slab to a temperature in the range 950 to 1300° C. includes heating the steel slab to a temperature in the range 1000 to 1300° C., the hot rolling step also comprises a hot rolling stage of type II 3 , which is performed prior to the hot rolling stage of type I 5 , for hot rolling the steel slab in a temperature above the RLT in the recrystallization regime in order to refine the austenite grain size. In order to achieve the targets of this invention, the hot rolling step includes a hot rolling stage of type I 5 that is performed in the no-recrystallization temperature range, i.e. below RST and above the ferrite formation temperature $A_3$. If the hot rolling step comprises both a hot rolling stage of type I 5 that is performed in the no-recrystallization temperature range, i.e. below RST and above the ferrite formation temperature $A_3$ and a hot rolling stage of type II 3 for hot rolling the steel slab in a temperature above the RLT in the recrystallization regime, there may be a waiting period 4 without including any hot rolling between the hot rolling stage of type II 3 and the hot rolling stage of type I 5 . A purpose of such waiting period 4 between the hot rolling stage of type II 3 and the hot rolling stage of type I 5 is to let the temperature of the hot-rolled steel to drop down below the RST temperature. It is also possible to have other waiting periods during the hot rolling stage of type II 3 and the hot rolling stage of type I 5 . It is also possible that the hot rolling step includes a hot rolling stage of type III that is performed in the waiting period 4 in the temperature range below the RLT and above the RST. Such a practice may be desirable for productivity reasons for example.

If the hot rolling step comprises a hot rolling stage of type I, a hot rolling stage of type II, and a hot rolling stage of type III, the steel slab is preferably, but not necessarily, uninterruptedly rolled during the hot rolling stage of type I, during the hot rolling stage of type II, and during the hot rolling stage of type III and when shifting from hot rolling stage of type II to hot rolling stage of type III and correspondingly when shifting from hot rolling stage of type III to hot rolling stage of type I.

Hot rolling is not realized below $A_3$ because otherwise the high yield strength is not achieved.

The hot rolling stage of type I 5 in the no-recrystallization temperature range followed by the quenching step 6 results in fine packets and blocks of fine martensite laths shortened and randomized in different directions in the microstructure. The correct state of the austenite prior to the quenching step 6 and partitioning treatment step 7 is essential to ensure the fineness of the subsequent martensite and the nature of the carbon partitioning to the finely divided submicron-sized austenite pools and laths. Finely divided nano/submicron size austenite pools/laths between martensite laths provide the requisite work hardening capacity thus improving the balance of elongation to fracture and tensile strength for this high-strength structural steel.

According to one embodiment, the hot rolling stage of type I 5 in the no-recrystallization temperature range includes of at least 0.4 total accumulated equivalent strain. This is because, a total accumulated von Mises equivalent strain of 0.4 below the RST is considered to be the preferred minimum needed to provide sufficient austenite conditioning prior to the quenching step 6 and the partitioning treatment step 7.

This means that grain aspect ratio (GAR) of prior austenite grain (PAG) can be such as 2.2 to 8.0 or 2.3 to 5.0 corresponding to total accumulated equivalent strain of 0.4 to 1.1 and 0.4 to 0.8, respectively, for instance.

In this description, the term "strain" means the equivalent von Mises true plastic strain. It describes the extent of plastic deformation during rolling passes, or the compression steps in the Gleeble simulation experiments described below, or prestrain given to the steel before use. It is given by the following equation:

$$\epsilon_{eq}=\{2(\epsilon_1^2+\epsilon_2^2+\epsilon_3^2)/3\}^{1/2}$$

where $\epsilon_1$, $\epsilon_2$, and $\epsilon_3$ are the principle plastic true strains in the steel such that $$\epsilon_1+\epsilon_2+\epsilon_3=0.$$

True strain is given by the natural logarithm of the ratio of the length of a volume element after plastic strain (h) to that before plastic strain (H), i.e.

$$\epsilon=\ln(h/H).$$

It can be seen that while true strain can be either positive or negative, equivalent strain is always a positive quantity irrespective of whether the principle strain is tensile or compressive.

As an example of the above, an accumulated true equivalent strain of 0.4 corresponds to a thickness reduction of 29% in plate rolling or an area reduction of 33% in bar rolling.

The hot rolling step is preferably realized so that the final thickness of hot-rolled steel is 3 to 20 mm and according to embodiments described in more detail later in this description, the thickness ranges are 3 to 11 and 11 to 20 mm.

Immediately after the hot rolling step the hot-rolled slab is in a quenching step 6 quenched to a temperature between $M_s$ and $M_f$ temperatures at a cooling rate of at least 20° C./s. This quenching step 6 i.e., forced cooling provides a mixture of martensite and austenite. During the partitioning treatment step 7, carbon partitions into the austenite thereby increasing its stability with regard to transformation to martensite in a subsequent cooling step 8 to room temperature. It can be understood that during the partitioning treatment step 7 some of, but not all of, the carbon transfers from martensite into the austenite. In this way, after cooling to room temperature, a small fraction of finely divided austenite 10 is retained between the transformed martensite laths 11. As a result, the martensitic matrix provides the required strength, while the small fraction of retained austenite distributed very finely between the martensitic laths improves the work hardening rate, total uniform elongation and impact toughness.

As generally known, direct quenching means that all thermomechanical processing operations, i.e., hot rolling steps 3, 5 are completed prior to accomplishing the quenching 6 directly from the heat available in the hot-rolling process. This means that any separate post-heating steps to hardening temperatures are not needed in any case.

Furthermore, as understood from the above, the method does not include any additional heating step from temperatures below $M_f$ after quenching, such as tempering steps, which would require more heating energy.

According to one embodiment, in the quenching step 6 , the hot-rolled steel slab is quenched to a temperature between $M_s$ and $M_f$ temperatures at a cooling rate of at least corresponding to the critical cooling rate (CCR).

$M_s$ and $M_f$ temperatures vary according to the chemical composition of the steel. They can be calculated using formulae available in the literature, or measured experimentally using dilatometric measurements.

According to one embodiment the quenching stop temperature (QT) is less than 400° C., but more than 200° C.

The quenching stop temperature (QT) is preferably selected such that a suitable amount of austenite remains in the microstructure after the quenching step 6 at QT at the start of the partitioning treatment step 7. This means that QT must be greater than $M_f$. A suitable amount of austenite is at least 5% in order to assure sufficient retained austenite at room temperature for improved ductility and toughness. On the other hand, the amount of austenite at QT immediately after quenching cannot be higher than 30%. Microstructures in this description are given in terms of volume percentages.

According to one preferred embodiment depicted in FIG. 1 with a reference number 7, the partitioning treatment step 7 is preferably realized substantially at quenching stop temperature (QT).

According to alternative embodiment depicted in FIG. 1 with a reference number 9, the partitioning treatment step 9 is realized substantially above quenching stop temperature (QT), preferably above the $M_s$ temperature. Heating to a temperature above the quenching stop temperature (QT) can be realized, for instance, by induction heating equipment on a hot rolling mill.

It is preferred that partitioning treatment step (7 or 9 ) is realized at a temperature in the range 250 to 500° C.

The partitioning treatment step 7, 9 is preferably realized so that the average cooling rate during partitioning treatment step 7, 9 is less than the average cooling rate in free air cooling at the temperature concerned. The maximum average cooling rate during this step can be for instance 0.2° C./s i.e., much less than the cooling rate with free air cooling at the temperature concerned (QT). Retardation of the cooling rate can be realized in various ways.

According to one embodiment, the method comprises a coiling step that is performed after the quenching step 6 and before the partitioning treatment step 7, 9 . In this embodiment, the cooling rate is reduced by coiling strip material subsequent to quenching step 6 . The coil allows very slow cooling, but in some cases, it can be preferred to use also thermal shields on the coils in order to further decrease cooling rate. In this case the partitioning treatment step 7, 9 is realized after the coil is wound and it is indistinguishable from the final cooling step 8 .

According to one embodiment, the cooling rate is limited by thermal shields applied to hot-rolled steel plates or bars.

According to one embodiment, the partitioning treatment step 7, 9 is realized at an essentially constant temperature. This can be realized for example in a furnace.

It is preferred that partitioning treatment step 7, is realized for 10 to 100000 s, preferably within the time period 600 to 10000 s calculated from reaching of the quenching stop temperature (QT).

The cooling step 8 takes naturally place after the partitioning treatment step 7, 9. This can be free air cooling or accelerated cooling to room temperature.

The method can provide a structural steel having a yield strength $R_{p0.2}\geq 960$ MPa, preferably $R_{p0.2}\geq 1000$ MPa.

According to one embodiment, a prestraining step is performed subsequent to partitioning treatment step 7, 9 . Prestraining of 0.01-0.02 subsequent to the partitioning treatment step 7, 9 can result in the structural steel having yield strength $R_{p0.2}\geq 1200$ MPa.

It is preferred, but not necessarily, that the steel slab as well as the hot-rolled high-strength structural steel product includes, in terms of mass percentages, iron and unavoidable impurities, and further at least the following:

C: 0.17 to 0.23%,

Si: 1.4 to 2.0% or Si+Al: 1.2 to 2.0%, where Si is at least 0.4% and Al is at least 0.1%, preferably at least 0.8%, Mn: 1.4 to 2.3%, and Cr: 0.4 to 2.0%.

Reasons for the limits of this preferred chemistry are the following:

Carbon, C, in the specified range is needed to achieve the desired strength level together with sufficient toughness and weldability. Lower levels of carbon will result in too low a strength, while higher levels will impair the toughness and weldability of the steel.

Both silicon, Si, and aluminum, Al, prevent carbide formation (such as iron carbide, cementite) and promote carbon partitioning from supersaturated martensite to finely divided austenite. Those alloying elements help carbon to stay in solution in the austenite during and after the partitioning treatment 7, 9 by hindering the formation of carbides. As high silicon content can cause poor surface quality, a partial substitution of silicon with aluminum, Al, is possible. This is because, the effect of aluminum in stabilizing the austenite is somewhat weaker compared to silicon. Aluminum is known to raise the transformation temperatures and hence, the chemistry needs to be carefully controlled to prevent extension of intercritical region or formation of strain induced ferrite during rolling and/or subsequent accelerated cooling. This is why, the steel slab as well as the hot-rolled high-strength structural steel preferably includes, in terms of mass percentages, Si: 1.4 to 2.0% or alternatively Si+Al: 1.2 to 2.0%, where Si is at least 0.4% and Al is at least 0.1%, preferably at least 0.8%, in terms of mass percentages of the steel slab or of the structural steel. This definition includes both, the first main embodiment (referred as high-Si embodiment) and a second main embodiment (referred as high-Al embodiment).

Manganese, Mn, in the specified range provides hardenability enabling the formation of martensite during quenching and avoiding the formation of bainite or ferrite. This is why there is a lower limit of 1.4%. The upper limit of manganese 2.3% is to avoid excessive segregation and structural banding, which is detrimental to ductility. Chromium, Cr, in the specified range also provides hardenability enabling the formation of martensite during quenching and avoiding the formation of bainite or ferrite. This is why there is a lower limit of 0.4%. The upper limit of 2.0% is to avoid excessive segregation and structural banding, which is detrimental to ductility.

According to a first main embodiment (referred as high-Si embodiment), silicon, Si, is needed at least 1.4% to prevent carbide formation and promote carbon partitioning from supersaturated martensite to finely divided austenite. High silicon content helps carbon to stay in solution in the austenite during and after the partitioning treatment 7, 9 by hindering the formation of carbides. According to this first embodiment (referred as high-Si embodiment) the steel slab as well as the hot-rolled high-strength structural steel includes, in terms of mass percentages, iron and unavoidable impurities, and further at least the following:

C: 0.17 to 0.23%,

Si: 1.4 to 2.0%,

Mn: 1.4 to 2.3%, and

Cr: 0.4 to 2.0%.

According to a second main embodiment (referred as high-Al embodiment) the steel slab as well as the hot-rolled high-strength structural steel includes, in terms of mass percentages, iron and unavoidable impurities, and further at least the following:

C: 0.17 to 0.23%,

Si+Al: 1.2 to 2.0%, where Si is at least 0.4% and Al is at least 0.1%, preferably at least 0.8%, Mn: 1.4 to 2.3%, Cr: 0.4 to 2.0%, and Mo: 0 to 0.7%, preferably Mo 0.1 to 0.7%.

According to a preferred version of the second main embodiment (referred as high-Al embodiment) the steel slab as well as the hot-rolled high-strength structural steel includes, in terms of mass percentages, iron and unavoidable impurities, and further at least the following C: 0.17 to 0.23%, Si+Al: 1.2 to 2.0%, where Si is 0.4 to 1.2% and Al is 0.8 to 1.6%, most preferable Si is 0.4 to 0.7% and Al is 0.8 to 1.3%, Mn: 1.4 to 2.3%, Cr: 0.4 to 2.0%, and Mo: 0 to 0.7%, preferably Mo 0.1 to 0.7%.

Molybdenum, Mo, in the specified range, preferably 0.1 to 0.7% delays bainite reaction thus improving hardenability. Although Mo is known to promote carbide formation from a thermodynamic point of view, but due to its strong solute drag effect, the carbide precipitation is actually retarded or stopped at lower temperatures, thus facilitating carbon partitioning and stabilization of austenite. Besides improving the strength and ductility of steels, it can actually facilitate the possibility of lowering the silicon level required.

Irrespective of how the carbon partitioning is accomplished, it is preferred that the steel chemistry provides further suitable hardenability.

Hardenability can be determined in various ways. In this patent description, the hardenability may be determined by DI, where DI is a hardenability index based on a modification of the ASTM standard A255-89 given by the following formula:

$$DI=13.0C\times(1.15+2.48Mn+0.74Mn^2)\times(1+2.16Cr)\times(1+3.00Mo)\times(1+1.73V)\times(1+0.36Ni)\times(1+0.70Si)\times(1+0.37Cu) \quad (1)$$

in which the alloying elements are in wt. % and DI in mm.

In one embodiment, the hot rolling is realized so that the thickness of hot-rolled steel is 3 to 20 mm, preferably 3 to 11 mm and the steel slab as well as the hot-rolled high-strength structural steel includes, in terms of mass percentages, such a composition that the hardenability index DI as calculated using the formula (1) is more than 70 mm. This ensures the hardenability especially of strip or plate products having thickness 3 to 11 mm without undesired bainite formation.

Table 1 shows earlier mentioned chemical composition ranges in the first main embodiment (referred as high-Si embodiment) and respectively in the second main embodiment (referred as high-Al embodiment), that has been invented to give requisite properties especially in strip or plate products having thickness 3 to 11 mm and produced according to the method.

Further, Table 1 shows upper limits for possible additional alloying elements in the first main embodiment (referred as high-Si embodiment) and respectively in the second main embodiment (referred as high-Al embodiment), such as Mo (≤0.3%, ≤0.7%, respectively), Ni (≤1.0%, ≤1.0%, respectively), Cu (≤1.0%, ≤1.0%, respectively) and V (≤0.06%, ≤0.06%, respectively), which one or more alloying element, which are also individually selectable, is preferred in order to extend the method according to the invention to thicker plates up to 20 mm, such as to thicknesses 11 to 20 mm. For instance, one or more of alloying elements Mo, Ni, Cu, Nb, V as given in Table 1, can be used to increase the hardenability especially of thicker plates 11 to 20 mm. Also other alloying elements increasing hardenability may be used.

TABLE 1

Chemical composition ranges of preferred embodiments

| Steel | | C | Si | Mn | Cr | Mo | Ni | Cu | V | Nb | Al |
|---|---|---|---|---|---|---|---|---|---|---|---|
| Hi-Si | Min. | 0.17 | 1.40 | 1.40 | 0.40 | 0.00 | 0.00 | 0.00 | 0.00 | 0.00 | 0.01 |
| DQP | Max. | 0.23 | 2.00 | 2.30 | 2.00 | 0.30 | 1.00 | 1.00 | 0.06 | 0.03 | 0.10 |
| Hi-Al | Min. | 0.17 | 0.50 | 1.40 | 0.40 | 0.00 | 0.00 | 0.00 | 0.00 | 0.00 | 0.70 |
| DQP | Max. | 0.23 | 0.70 | 2.30 | 2.00 | 0.70 | 1.00 | 1.00 | 0.06 | 0.03 | 1.30 |

In another embodiment, the hot rolling 3, 5 is realized so that the thickness of hot-rolled steel is 3 to 20 mm, preferably 11 to 20 mm and the steel slab as well as the hot-rolled high-strength structural steel includes, in terms of mass percentages, such a composition that the hardenability index DI as calculated using the formula (1) is at least 125 mm. This ensures the hardenability especially of strip or plate products having thickness 11 to 20 mm without undesired bainite formation.

In addition to the elements mentioned in equation 1, an addition of boron B, in terms of mass percentages, 0.0005 to 0.005%, can be made to increase DI, i.e. the hardenability, of the TMR-DQP steels. The effect of boron is described by the boron multiplying factor BF described more detailed in the ASTM standard A255-89. Steels including boron can be processed in the manner described for boron-free steels.

In the first main embodiment (referred as high-Si embodiment), above mentioned addition of boron will also require an addition of Ti, in terms of mass percentages, 0.01 to 0.05%, to form TiN precipitates and prevent boron B from reacting with the nitrogen N in the steel during thermomechanical processing. However, in such cases, the steel may have somewhat lower impact properties due to the presence of TiN inclusions. The harmful effects of TiN inclusions can, however, be counteracted by an addition of Ni up to 4%, such as 0.8 to 4%, giving impact properties equivalent to those of non-boron DQP steels.

In the second main embodiment (referred as high-Al embodiment), an addition of boron B, in terms of mass percentages, 0.0005 to 0.005% can be added also without a deliberate addition of Ti as nitrogen N will be bound as AlN.

It is also possible, but not necessary, that steel slab as well as the hot-rolled high-strength structural steel does not contain titanium, Ti, as a deliberate addition. This is because, as understood from above, titanium may form TiN which may affect toughness. In other words, the steel slab as well as the hot-rolled high-strength structural steel is preferably, but not necessarily, Ti-free.

Furthermore, as demonstrated later in the examples, desired hardenability may be achieved also without boron, so in essence, there is not necessarily any need to alloy titanium from this point of view. As understood from the above, the steel slab as well as the hot-rolled high-strength structural steel is possibly, but not necessarily also B-free.

It is also possible, but not necessary, that the steel slab as well as the hot-rolled high-strength structural steel does not contain niobium, Nb. However, small additions of Nb can be used to control the RST and thereby facilitate TMR (rolling of type I 5). For this reason, the steel slab as well as the hot-rolled high-strength structural steel may comprise 0.005 to 0.05%, such as 0.005 to 0.035% Nb.

Especially in the first main embodiment (referred as high-Si embodiment), Al 0.01 to 0.10% is preferred to use to kill the steel and thereby achieve low oxide inclusion levels. In addition, the steel slab as well as the hot-rolled high-strength structural steel may include small amounts of calcium, Ca, which may be present for instance due to the inclusion control of Al-killed steel in the foundry.

Further, it is preferred that maximum permitted levels of impurity elements P, S and N are, in terms of mass percentages, the following P<0.012%, S<0.006% and N<0.006%, which means that these levels are to be controlled adequately through good melting practice in order to achieve good impact toughness and bendability.

In cases where there is no deliberate addition, the steel slab and the steel product can contain, in terms of mass percentages, residual contents such as Cu: less than 0.05%,
Ni: less than 0.07%,
V: less than 0.010%,
Nb: less than 0.005%,
Mo: less than 0.02%,
Al: less than 0.1%,
S: less than 0.006%,
N: less than 0.006%, and/or
P: less than 0.012%.

The exact combination of alloying elements chosen will be determined by the product thickness and the cooling power of the equipment available for direct quenching. In general, the aim will be to use the minimum level of alloying consistent with the need to achieve a martensitic microstructure without the formation of bainite or ferrite during quenching. In this way, production costs can be kept to a minimum.

The high-strength structural steel product has a yield strength $R_{p0.2} \geq 960$ MPa, preferably $R_{p0.2} \geq 1000$ MPa, and is characterized by a microstructure comprising at least 80% martensite and 5 to 20% retained austenite.

At least 80% martensite is required to achieve the desired strength and 5-20% retained austenite is required to achieve high impact toughness and ductility.

It is preferable that the high-strength structural steel product has a Charpy V 27J temperature (T27J) of less than −50° C., preferably less than −80° C.

Charpy V 27J temperature (T27J) means the temperature at which the impact energy 27J can be achieved with impact specimens according to the standard EN 10045-1. Impact toughness improves as T27J decreases.

Mechanical properties are proved later in this description.

Figure 2:
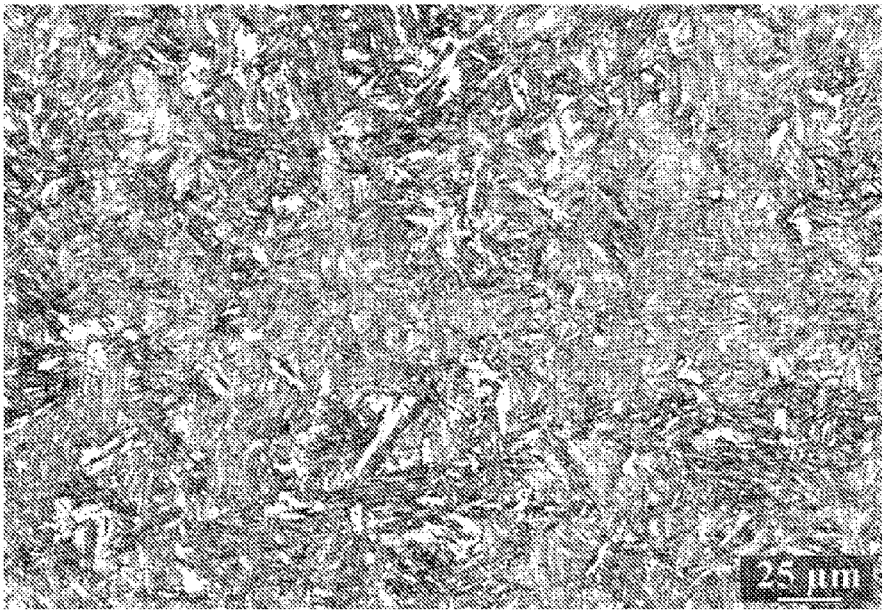
FIG. 2 depicts the microstructure of a high-strength structural steel having retained austenite and fine packets/blocks of fine martensitic laths, shortened and randomized in different directions.
Figure 3:
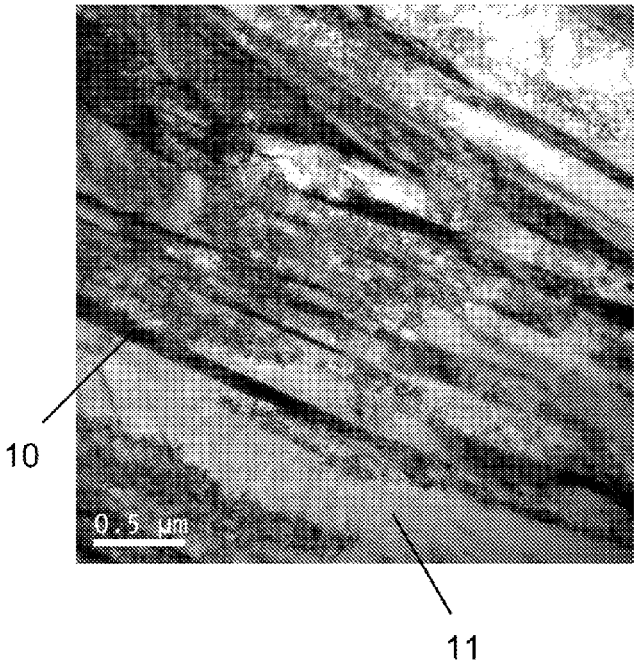
FIG. 3 depicts a TEM micrograph of a Gleeble simulated specimen having packets/blocks of fine martensitic laths (white) and interlath austenite (dark)

FIG. 2 depicts the preferred microstructure of the high-strength structural steel product as seen using light microscopy, i.e. fine martensitic laths, shortened and randomized in different directions and retained austenite. FIG. 3, a transmission electron micrograph, shows the presence of elongated pools of austenite (dark) 10 between the martensite laths 11. The presence of retained austenite was also visible in SEM-EBSD micrographs.

The fineness of the retained austenite 10 (submicron/nanometer size) improves its stability such that during straining, such as during stretch-flanging or bending or overloading, the retained austenite transforms to martensite over a large range of strain. In this way, 5 to 20% retained austenite imparts improved formability and overload bearing capacity to the high-strength structural steel product.

As understood above, the retained austenite is stabilized by carbon partitioning from supersaturated martensite to austenite. Thereby stable retained austenite is achieved.

Even though a small amount of transition carbides might be present in the steel, it can be said that the steel product according to the invention is preferably substantially free of iron carbides (such as cementite), most preferably, but not necessarily it is substantially free of carbides formed after fcc (face-centered cubic) to bcc (body-centered cubic) transformation.

Figure 9:
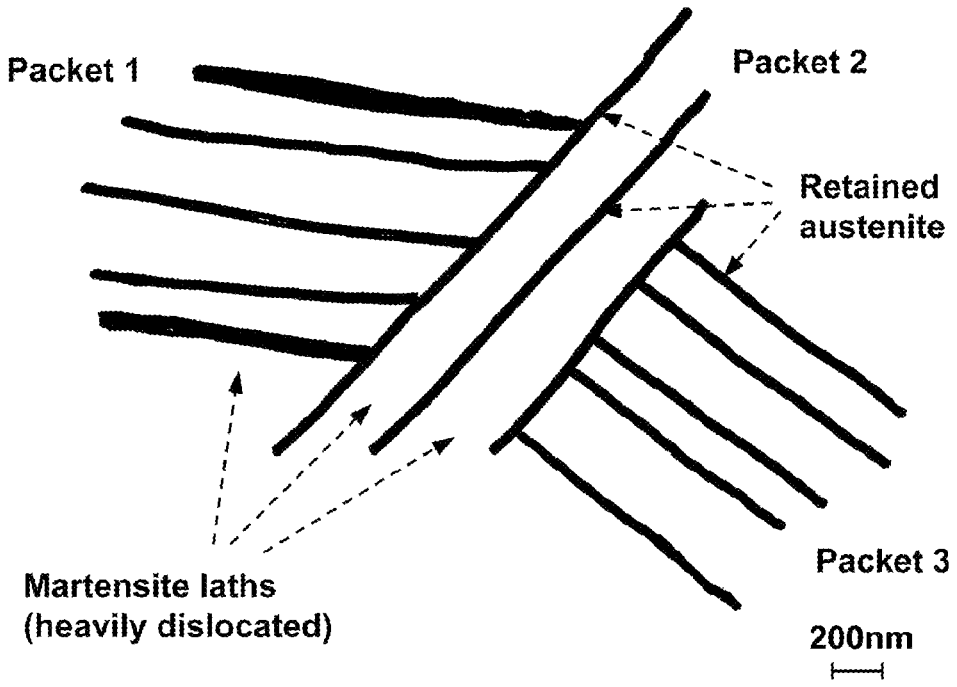
FIG. 9 depicts a schematic drawing of microstructure according to the one embodiment of the invention.

FIG. 9 depicts a schematic drawing of microstructure according to one embodiment of the invention. As can be seen, microstructure consists of several packets. In some cases, these packets (packet 1, 2 and 3 etc.) can extend up to the size of prior austenite grain (PAG). As can also be seen, the microstructure consists of martensite laths and retained austenite. Each packet consists of martensite laths 11, shortened and randomized in different directions, and a small fraction of finely divided retained austenite 10 between the martensite laths, which are heavily dislocated. The microstructure, as drawn in FIG. 9, is substantially free of carbides.

According to one embodiment, the high-strength structural steel product is a plate steel.

According to another embodiment, the high-strength structural steel product is a strip steel.

According to another embodiment, the high-strength structural steel product is a long steel product in the form of bar.

Examples of the First Main Embodiment (Referred as High-Si Embodiment)

The first main embodiment (referred as high-Si embodiment) of the present invention is now described by examples, in which an experimental steel containing (in wt. %) 0.2C-2.0Mn-1.5Si-0.6Cr has been hot rolled, direct quenched into the $M_s$-$M_f$ range and partitioning treated in order to prove feasibility of the invention for making structural steels having a yield strength at least 960 MPa with improved combination of strength, ductility and impact toughness.

Two austenite states prior to quenching were investigated: strained and recrystallized. Thermomechanical simulations were carried out in a Gleeble simulator to determine appropriate cooling rates and cooling stop temperatures for obtaining martensite fractions in the range 70 to 90% at the quenching stop temperature QT. Subsequent laboratory rolling experiments showed that desired martensite-austenite microstructures were achieved, and ductility and impact toughness were improved in this high-strength class.

The invention will be now described in greater detail with the aid of 1) the results of Gleeble simulation experiments and 2) the results of laboratory hot rolling experiments.

1. Gleeble Simulation Experiments

Preliminary dilatation tests were carried out on a Gleeble simulator to roughly simulate industrial rolling with high and low finish rolling temperatures, resulting in respectively undeformed (recrystallized) and deformed (strained) austenites prior to quenching.

For undeformed austenite, samples were reheated at 20° C./s to 1150° C., held for 2 min, and cooled at 30° C./s to below the $M_s$ temperature giving initial martensite fractions in the range 70 to 90%. The samples were then held to allow partitioning of carbon for 10 to 1000 s at or above the quenching stop temperature QT, followed by cooling in air between the Gleeble anvils (~10-15° C./s down to 100° C.).

Figure 4:
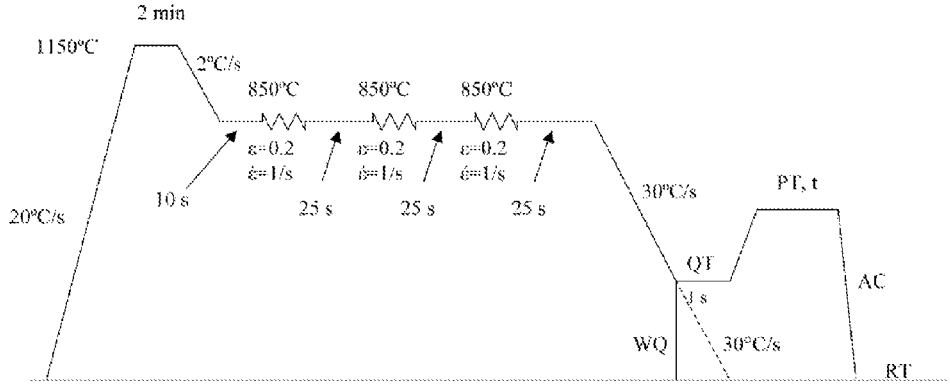
FIG. 4 depicts a temperature-time curve of one embodiment according to the invention.

In the case of deformed austenite, samples were reheated in a similar manner, cooled to 850° C., held 10 s, and then compressed with three hits each having a strain of ~0.2 at a strain rate of 1 $s^{-1}$. The time between hits was 25 s. The specimens were then held 25 s prior to cooling at 30° C./s to a quenching temperature below $M_s$ giving initial martensite fractions of 70 to 90%. FIG. 4 depicts a temperature vs. time schematic of this thermomechanical simulation schedule.

The dilatation curves of specimens cooled at 30° C./s enabled measurements of $M_s$ (395° C.) and $M_f$ temperatures (255° C.). These were as expected on the basis of standard equations given in the literature. The dilatometer results suggested that initial martensite fractions of about 70, 80 and 90% would be present at quenching temperatures of 340, 320 and 290° C., respectively.

Following direct quenching of recrystallized undeformed austenite, coarse packets and blocks of martensite laths were seen in the microstructure. However, specimens that were compressed at 850° C. prior to quenching showed finer packets and blocks of martensite 11 laths, shortened and randomized in different directions, FIG. 2. Elongated pools of austenite 10 were present between the martensite laths. An example of finely divided interlath austenite 10 is shown in FIG. 3.

Final austenite 10 fractions varied in the range 7 to 15%; generally increasing with higher quench stop temperature QT (290, 320, 340° C.) and/or partitioning temperature PT (370, 410, 450° C.).

2. Laboratory Rolling Experiments

Figure 5:
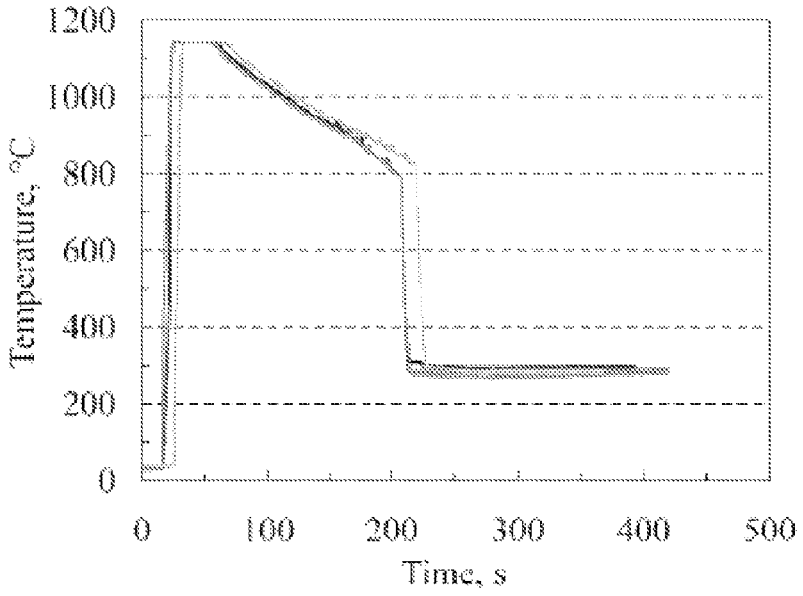
FIG. 5 depicts a temperature-time curve of one embodiment according to the invention.

Based on the results of the dilatation experiments, rolling trials were made using a laboratory rolling mill starting with slabs 110×80×60 mm cut from the cast ingots, having a composition in wt. % of 0.2C-2.0Mn-1.5Si-0.6Cr. The rolling was done in the fashion shown in FIG. 1. The temperature of the samples during hot rolling and cooling was monitored by thermocouples placed in holes drilled in the edges of the samples to the mid-width at mid-length. The samples were heated at 1200° C. for 2 h (steps 1 and 2 in FIG. 1) in a furnace prior to two-stage rolling (steps 3-5 in FIG. 1). Step 3 i.e. hot rolling step of type II comprised hot rolling in four passes to a thickness of 26 mm with about 0.2 strain/pass with the temperature of the fourth pass about 1040° C. Waiting step 4 comprised waiting for the temperature to drop below 900° C., which was estimated to be the RST, and step 5 i.e., hot rolling step of type I comprised hot rolling to a final thickness of 11.2 mm with four passes of about 0.21 strain/pass with a finish rolling temperature (FRT) in the range 800 to 820° C. (>$A_3$), FIG. 5. All rolling passes were in the same direction, i.e. parallel to the long side of the slab. Immediately after hot rolling 3, 5, the samples were quenched 6, i.e., cooled at cooling rate of at least 20° C./s (average cooling rates about 30 to 35° C./s down to about 400° C.), in a tank of water to close to 290 or 320° C. (QT) and then subjected to partitioning treatment 7 in a furnace at the same temperature for 10 minutes, FIG. 5.

Microstructural features of laboratory high-strength DQ&P material in respect of martensite block and packet sizes were quite similar to those seen in optical microstructures of Gleeble simulated specimens, indicating that the deformation conditions in hot rolling and direct quenching to QT were suitably controlled. The microstructure of the plate rolled to a low FRT consisted of fine packets and blocks of fine martensite laths 11, shortened and randomized in different directions, and austenite 10 contents (as measured by XRD) in the range 6 to 9%, irrespective of quenching and furnace temperature (290 or 320° C.).

Table 2 presents a summary of process parameters and mechanical properties of the laboratory rolled plates A, B and C, all having the composition 0.2C-2.0Mn-1.5Si-0.6Cr. Table 2 clearly shows an all-round improvement in the properties as a result of TMR-DQP, i.e. after two-stage rolling with the hot rolling stage of type I 5 below the RST (FRT=800° C.) in comparison to rolling including only the hot rolling stage of type II 3 (FRT=1000° C.). It is also clear that properties are improved in comparison to simple direct quenching of a lower carbon steel having a similar yield strength.

Figure 6:
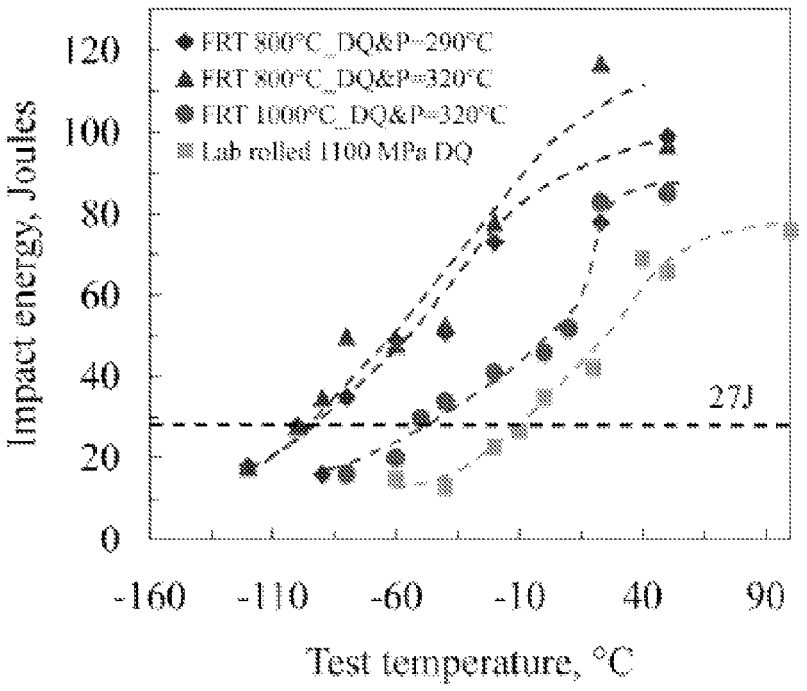
FIG. 6 depicts test results of the first main embodiment (referred as high-Si embodiment) related to impact toughness in comparison to direct quenched steel without partitioning treatment.

Individual values of absorbed energy are shown in FIG. 6. It can be seen from FIG. 6 that FRT 800° C. followed by direct quenching and partitioning treatment (plates A and B) causes improved impact strength compared to FRT 1000° C. followed by direct quenching and partitioning treatment (plate C) or compared to simple direct quenching to room temperature of a lower carbon steel (plate D).

Further, surprisingly, despite the fact that the carbon content of specimens A and B (0.20%) is higher than the carbon content of specimen D (0.14%), the temperature corresponding to 27J Charpy V impact energy (T27J) and 50% shear fracture (T50%) for plates A and B are distinctly lower, i.e. better, than for plate D.

TABLE 2

Process parameters and mechanical properties for 11.2 mm thick plates, according to the first main embodiment (referred as high-Si embodiment)

| Plate/tensile specimen | FRT (C.) | QT (C.) | $R_{p0.2}$ (MPa) | $R_{p1.0}$ (MPa) | $R_m$ (MPa) | A25 (%) | A (%) | $A_{gt}$ (%) | $A_g$ (%) | Z (%) | T27J (C.) | T50% (C.) |
|---|---|---|---|---|---|---|---|---|---|---|---|---|
| A1 | 800 | 290 | 1035 | 1320 | 1476 | 17.6 | 13.4 | 5.3 | 4.5 | 52.5 | −99 | −28 |
| A2 | | | 1093 | 1355 | 1499 | 14.7 | 12.9 | 5.7 | 4.9 | 54.3 | | |
| A3 | | | 1035 | 1341 | 1492 | 16.2 | 14.1 | 5.5 | 4.8 | 52 | | |
| B1 | 800 | 320 | 1062 | 1374 | 1463 | 13.4 | 12.2 | 3.7 | 2.9 | 58.1 | −100 | −6 |
| B2 | | | 1023 | 1373 | 1481 | 15.7 | 14.4 | 3.9 | 3.2 | 56.9 | | |
| B3 | | | 1046 | 1382 | 1483 | 16.6 | 13.9 | 4.4 | 3.6 | 55.3 | | |
| C1-R | 1000 | 320 | 966 | | 1382 | 16.3 | 14.2 | 4.2 | 3.5 | 56.1 | −44 | 15 |
| C2-R | | | 943 | | 1397 | 17.5 | 13.5 | 4.7 | 4 | 54.4 | | |
| C3-R | | | 951 | | 1399 | 15.2 | 13.8 | 4.4 | 3.7 | 56.4 | | |
| D1-R | 800* | | 1131 | | 1454 | 12.5 | 11.4 | 3.6 | 2.9 | 58.5 | −12 | 25 |
| D2-R | | | 1088 | | 1443 | 12.6 | 11.7 | 3.1 | 2.5 | 54.6 | | |
| D3-R | | | 1105 | | 1459 | 13.7 | 11.5 | 3.7 | 3 | 57.8 | | |

* Low C. fully martensitic DQ steel

The mechanical properties of plates A, B and C produced by direct quenching & partitioning (DQ&P) were compared with plate D obtained using simple direct quenching to below the $M_f$ temperature, i.e. to room temperature, using a steel with a composition giving similar yield strength properties, i.e., in wt. % 0.14C-1.13Mn-0.2Si-0.71Cr-0.15Mo-0.033Al-0.03Ti-0.0017B. A slab of this steel was hot-rolled in the same way as described above using the two-stage rolling schedule to a low FRT and directly water quenching to room temperature.

For each plate, three tensile specimens were extracted. The 0.2% yield strength ($R_{p0.2}$) of plates A and B is marginally lower than the 1100 MPa obtained with D. Both yield and tensile strengths obtained with recrystallized DQ&P plates C (finish rolled at about 1000° C.) are lower than those of A and B having finish rolling temperatures (FRT) of 800° C. This shows the importance of thermomechanical rolling, i.e., straining of austenite on the subsequent phase transformation characteristics and resultant properties.

Prestraining the steel for some applications can be feasible or even natural and in these cases the yield strength in use will be raised above the $R_{p0.2}$ values in Table 2: the yield strength may then exceed 1100, 1200 or even 1300 MPa depending on the prestrain applied. This is implied by the high values of $R_{p1.0}$ shown by steels A and B.

As depicted in Table 2, low finish rolling temperature (FRT), ie., the hot rolling stage of type I 5 performed below the recrystallization stop temperature (RST) has a notable effect on impact toughness in context of DQ&P processing. For each plate approximately nine 10×10 mm Charpy V impact test specimens were tested at various temperatures across the ductile-brittle transition range. The results were used to determine the values of T27J and T50% in Table 2.

According to Table 2, temperatures corresponding to 27J Charpy V impact energy (T27J) of DQP steel can be less than −50° C. by using thermomechanical rolling, i.e., using a rolling stage of type I 5 at temperatures below the RST.

The TMR-DQP plates in Table 2 (A and B) satisfy the target related to good Charpy V impact toughness transition temperature T27J≤−50° C., preferably ≤−80° C. and also yield strength $R_{p0.2}$ at least 960 MPa together with good total uniform elongation.

While the total elongation (A) and reduction of area to fracture (Z) vary in a narrow range, the total uniform elongation ($A_{gt}$) and the plastic uniform elongation ($A_g$) are higher at the lower quenching temperature of 290° C. than the same properties obtained at quenching temperature 320° C., as can be seen in Table 2.

According to Table 2, the total elongation of A≥10%, even ≥12%, was achieved, which is also a good value at this strength level.

According to Table 2, the total uniform elongation of $A_{gt}$≥3.5% was achieved, even $A_{gt}$≥4.0%, which is also a good value at this strength level.

Its preferred that especially in first main embodiment (referred as high-Si embodiment), the quenching stop temperature (QT) is between $M_s$ and $M_f$ temperatures and further less than 300° C. but greater than 200° C. in order to achieve improved properties related to elongation.

The mechanical properties obtained in the invention are better than those obtained in conventionally quenched and tempered steels in the same strength class. Further, it must be noticed that the overall combination of mechanical properties is good, including strength, ductility and impact toughness properties. All these are obtained simultaneously.

Examples of the Second Main Embodiment (Referred as High-Al Embodiment)

The second main embodiment (referred as high-Al embodiment) of the present invention is now described by another example, in which an experimental steel containing (in wt. %) 0.2C-2.0Mn-0.5Si-1.0Al-0.5Cr-0.2Mo has been hot rolled, direct quenched into the $M_s$-$M_f$ range and partitioning treated in order to prove the feasibility of the invention for making structural steels having a yield strength at least 960 MPa with improved combination of strength, ductility and impact toughness.

Two austenite states prior to quenching were investigated: strained and recrystallized. Thermomechanical simulations were carried out in a Gleeble simulator to determine appropriate cooling rates and cooling stop temperatures for obtaining martensite fractions in the range 75 to 95% at the quenching stop temperature QT. Subsequent laboratory rolling experiments showed that desired martensite-austenite microstructures were achieved, and ductility and impact toughness were improved in this high-strength class.

The second main embodiment of the invention will be now described in greater detail with the aid of 1) the results of Gleeble simulation experiments and 2) the results of laboratory hot rolling experiments.

1. Gleeble Simulation Experiments

Preliminary dilatation tests were carried out on a Gleeble simulator to roughly simulate industrial rolling with high and low finish rolling temperatures, resulting in respectively undeformed (recrystallized) and deformed (strained) austenites prior to quenching.

For undeformed austenite, samples were reheated at 20° C./s to 1000° C., held for 2 min, and cooled at 30° C./s to below the $M_s$ temperature giving initial martensite fractions in the range 75 to 95%. The samples were then held to allow partitioning of carbon for 10 to 1000 s at the quenching stop temperature QT, followed by cooling in air between the Gleeble anvils (~10-15° C./s down to 100° C.).

Figure 7:
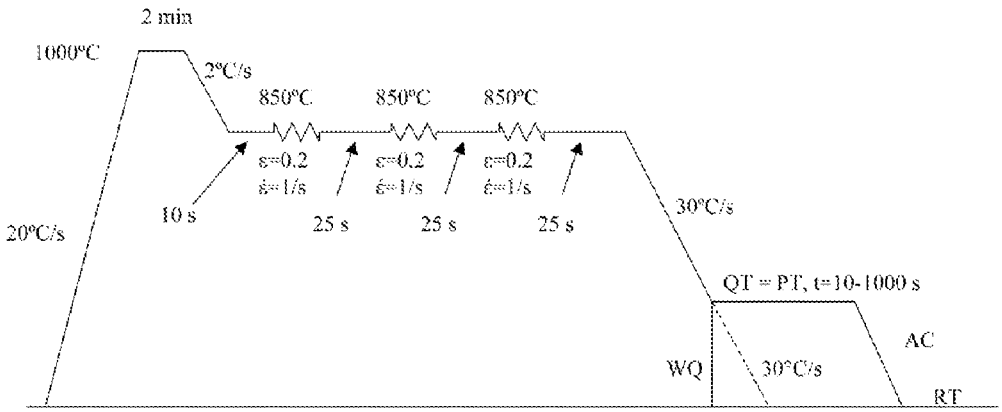
FIG. 7 depicts a temperature-time curve of one embodiment according to the invention.

In the case of deformed austenite, samples were reheated in a similar manner to the above, cooled to 850° C., held 10 s, and then compressed with three hits each having a strain of ~0.2 at a strain rate of 1 $s^{-1}$. The time between hits was 25 s. The specimens were then held 25 s prior to cooling at 30° C./s to a quenching temperature below $M_s$ giving initial martensite fractions of 75 to 95%. FIG. 7 depicts a temperature vs. time schematic of this thermomechanical simulation schedule.

The dilatation curves of specimens cooled at 30° C./s enabled measurements of $M_s$ (400° C.) and $M_f$ temperatures (250° C.). These were as expected on the basis of standard equations given in the literature. The dilatometer results suggested that initial austenite fractions of about 25, 12 and 7% would be present at quenching temperatures of 340, 310 and 290° C., respectively.

Following direct quenching of recrystallized undeformed austenite, coarse packets and blocks of martensite laths were seen in the microstructure. However, specimens that were compressed at 850° C. prior to quenching showed finer packets and blocks of martensite 11 laths, shortened and randomized in different directions, as also seen in High-Si DQP steel described above.

Final austenite 10 fractions varied in a narrow range of 5 to 10% regardless of quenching and partitioning temperatures (QT=PT) and/or times in the range 10 to 1000 s (average 9, 9 and 7% at 340, 310 and 290° C., respectively).

2. Laboratory Rolling Experiments

Based on the results of the dilatation experiments, rolling trials were made using reversing rolling on a laboratory rolling mill starting with 60 mm thick slabs having a length of 110 mm and width of 80 mm cut from the cast ingots, having a composition in wt. % of 0.2C-2.0Mn-0.5Si-1.0Al-0.5Cr-0.2Mo. The rolling was done in the fashion shown in FIG. 1. The temperature of the samples during hot rolling and cooling was monitored by thermocouples placed in holes drilled in the edges of the samples to the mid-width at mid-length. The samples were heated at 1200° C. for 2 h (steps 1 and 2 in FIG. 1) in a furnace prior to two-stage rolling (steps 3-5 in FIG. 1). Step 3, i.e hot-rolling step of type II comprised hot rolling in four passes to a thickness of 26 mm with about 0.2 strain/pass with the temperature of the fourth pass about 1040° C. Step 4 comprised waiting for the temperature to drop to about 920° C., which was estimated to be the RST, and step 5 i.e hot-rolling step of type I comprised hot rolling to a final thickness of 11.2 mm with four passes of about 0.21 strain/pass with a finish rolling temperature (FRT) ≥820° C. (>$A_3$). All rolling passes were parallel to the long side of the slab. Immediately after hot rolling 3, 5, the samples were quenched 6, i.e., cooled at cooling rate of at least 20° C./s (average cooling rates about 30 to 35° C./s down to about 400° C.), in a tank of water to temperatures close to 340, 320 or 270° C. (QT) and then subjected to partitioning treatment 7 in a furnace either at the same temperature for 10 minutes or during extremely slow cooling over 27 to 30 hours down to 50 to 100° C. This also enabled an understanding of the influence of coiling simulation CS on mechanical properties in comparison to those of partitioning for about 10 minutes.

Microstructural features of laboratory high-strength TMR-DQP material in respect of martensite block and packet sizes were quite similar to those seen in optical microstructures of Gleeble simulated specimens, indicating that the deformation conditions in hot rolling and direct quenching to QT were suitably controlled. The microstructure of the plate rolled to a low FRT consisted of fine packets and blocks of fine martensite laths 11, shortened and randomized in different directions, and final austenite 10 contents (as measured by XRD) in the range 4-7%, irrespective of quenching and furnace temperature (270-340° C.).

Table 3 presents a summary of process parameters and mechanical properties of the laboratory rolled plates A, B C, D and E all having the composition 0.2C-2.0Mn-0.5Si-1.0Al-0.5Cr-0.2Mo. Table 3 clearly shows a balanced improvement in the properties as a result of TMR-DQP, i.e. after two-stage rolling with hot rolling step of type I 5 below the RST (FRT≥820° C.). It is also clear that properties are improved in comparison to simple direct quenching of a lower carbon steel having a similar yield strength.

TABLE 3

Process parameters and mechanical properties for 11.2 mm thick plates, according to the second main embodiment (referred as high-Al embodiment)

| Plate/tensile specimen | FRT (C.) | QT (C.) | $R_{p0.2}$ (MPa) | $R_{p1.0}$ (MPa) | $R_m$ (MPa) | A25 (%) | A (%) | $A_{gt}$ (%) | $A_g$ (%) | Z (%) | T27J C. | T50% C. |
|---|---|---|---|---|---|---|---|---|---|---|---|---|
| A1 | 820 | 340 | 1082 | 1327 | 1365 | 13.6 | 12 | 2.9 | 2.2 | 52.9 | −55 | −7 |
| A2 | | | 1068 | 1316 | 1349 | 13.4 | 12.1 | 2.8 | 2.2 | 50.4 | | |
| A3 | | | 1071 | 1287 | 1318 | 15.4 | 12.8 | 2.9 | 2.2 | 55 | | |
| B1 | 825 | 340 CS | 1004 | 1200 | 1243 | 16.8 | 13.3 | 2.9 | 2.3 | 55.5 | −100 | −34 |

TABLE 3-continued

Process parameters and mechanical properties for 11.2 mm thick plates, according to the second main embodiment (referred as high-Al embodiment)

| Plate/tensile specimen | FRT (C.) | QT (C.) | $R_{p0.2}$ (MPa) | $R_{p1.0}$ (MPa) | $R_m$ (MPa) | A25 (%) | A (%) | $A_{gt}$ (%) | $A_g$ (%) | Z (%) | T27J C. | T50% C. |
|---|---|---|---|---|---|---|---|---|---|---|---|---|
| B2 | | | 1013 | 1214 | 1252 | 14.9 | 10.5 | 2.7 | 2.1 | 57.2 | | |
| B3 | | | 998 | 1196 | 1241 | 15.8 | 13.2 | 2.8 | 2.2 | 58.3 | | |
| C1 | 820 | 320 CS | 1009 | 1267 | 1390 | 12.7 | 10.6 | 4.3 | 3.6 | 48.3 | −90 | −6 |
| C2 | | | 1030 | 1274 | 1396 | 14.8 | 11.6 | 4.5 | 3.8 | 48.3 | | |
| D1 | 820 | 270 CS | 1157 | 1397 | 1484 | 9.2 | 8.2 | 3.7 | 3 | 45.9 | −87 | 0 |
| D2 | | | 1203 | 1428 | 1506 | 14.6 | 11.6 | 4.1 | 3.3 | 45.9 | | |
| E1 | 890 | 310 CS | 1128 | 1349 | 1398 | 11.1 | 9.9 | 3.2 | 2.4 | 47.1 | −67 | −4 |
| E2 | | | 1117 | 1346 | 1398 | 14.6 | 10.5 | 3 | 2.2 | 51.5 | | |
| E3 | | | 1111 | 1341 | 1392 | 10.8 | 8.4 | 3.1 | 2.3 | 54.6 | | |
| F1-R | 800* | | 1131 | | 1454 | 12.5 | 11.4 | 3.6 | 2.9 | 58.5 | −12 | 25 |
| F2-R | | | 1088 | | 1443 | 12.6 | 11.7 | 3.1 | 2.5 | 54.6 | | |
| F3-R | | | 1105 | | 1459 | 13.7 | 11.5 | 3.7 | 3 | 57.8 | | |

* Lower C. fully martensitic steel
CS = Coiling simulation

The mechanical properties of high-Al TMR-DQP steel plates A, B C, D and E at table 3 produced by direct quenching & partitioning (DQ&P) were compared with plate F at table 3 obtained using simple direct quenching to below the $M_f$ temperature, i.e. to room temperature, using a steel with a composition giving similar yield strength properties, i.e. in wt. % 0.14C-1.13Mn-0.2Si-0.71Cr-0.15Mo-0.033Al-0.03Ti-0.0017B. A slab of this steel was hot-rolled in the same way as described above using the two-stage rolling schedule to a low FRT and directly water quenching to room temperature. DQP plates A and B of high-Al DQP steel were produced by direct quenching and partitioning at 340° C. (Table 3). While plate A was partitioned for 10 minutes at 340° C. in a furnace followed by air cooling, plate B was transferred to a furnace maintained at 340° C., followed by switching off the furnace to allow it to cool very slowly over 27 to 30 hours, thus simulating coiling in actual industrial practice. Plates C and D were quenched at 320 and 270° C., respectively, followed by partitioning during slow cooling in the furnace.

For each plate, at least two tensile specimens were extracted. The mechanical properties of plates A and B produced by direct quenching & partitioning (DQ&P) at 340° C. show the influence of prolonged partitioning during slow cooling (plate B) compared with short time (10 min) partitioning and faster (air) cooling of plate A. Plate B has a slightly lower strength but a much better 27J Charpy-V impact transition temperature (T27J). This is why it is preferred, that the average cooling rate during partitioning treatment step 7, 9 is less than the average cooling rate in free air cooling at the temperature concerned.

Lowering the quenching temperature to 320° C. followed by slow cooling in a furnace (plate C) resulted in improved uniform elongation (3.7%), even though the reduction in area (Z) and impact properties were marginally impaired as compared to those of plate B. A further reduction in quenching temperature to 270° C. followed by slow cooling (plate D) showed higher yield and tensile strengths comparable to those of the reference steel (plate F), but there was only inappreciable change in the uniform elongation without loss of toughness.

An additional rolling test (plate E) with higher FRT at 890° C. required start of controlled rolling at 970° C., which falls in the partial recrystallization domain between RLT and RST, followed by quenching to 310° C. (similar to plate C) and slow cooling in a furnace simulating coiling CS. This test showed the influence of partial recrystallization prior to DQP on the mechanical properties of high-Al DQP steel. Rolling in the temperature regime between RLT and RST with a higher FRT temperature of 890° C. followed by quenching and partitioning at 310° C. (plate E) resulted in lower $A_g$ and higher T27J temperature, as a consequence of the higher $R_{p0.2}$ and $R_{p1.0}$ values compared to plate C, which was subjected to a very similar DQP treatment, but rolled at lower FRT. This strengthens the independent claim that, in DQP treatment, the hot rolling step should include a hot rolling stage of type I 5 for hot rolling the steel slab in the no-recrystallization temperature range below RST but above ferrite formation temperature $A_3$, Cold prestraining of the TMR-DQP steel for some applications can be feasible or even natural and in these cases the yield strength in use will be raised above the $R_{p0.2}$ values in Table 3: the yield strength may then exceed 1200 or 1300 MPa depending on the prestrain applied. This is implied by the high values of $R_{p1.0}$ shown by plates A to E.

Figure 8:
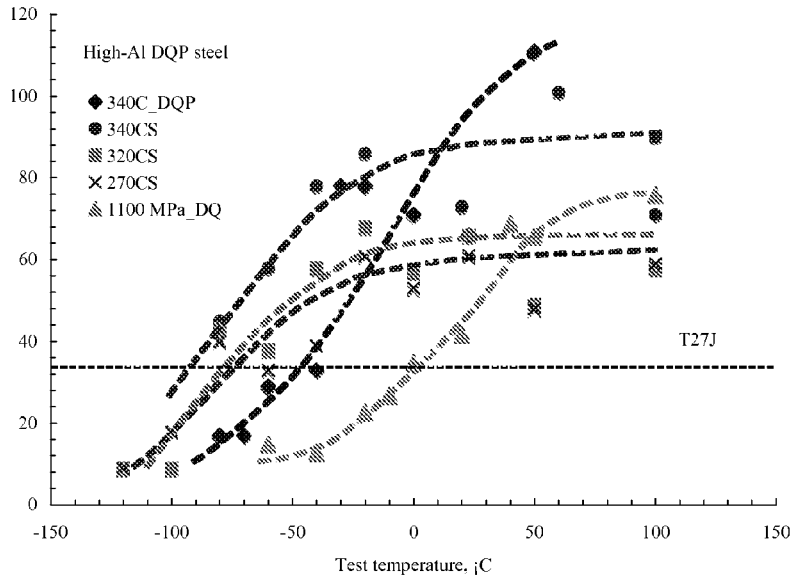
FIG. 8 depicts test results of the second main embodiment (referred as high-Al embodiment) related to impact toughness in comparison to direct quenched steel without partitioning treatment.

As depicted in Table 3, low finish rolling temperature (FRT), i.e. hot rolling step of type I 5 performed below the recrystallization stop temperature (RST) has a notable effect on impact toughness and elongation in the context of DQ&P processing. For each plate approximately nine 10×10 mm Charpy V impact test specimens were tested at various temperatures across the ductile-brittle transition range. The results were used to determine the values of T27J and T50% (50% shear fracture transition temperature) in Table 3. Individual values of absorbed energy are shown in FIG. 8. It can be seen from FIG. 8 that controlled rolling down to FRT 820° C. followed by accelerated cooling to quenching temperature and partitioning treatment during slow cooling in a furnace (plates B, C and D) causes improved impact strength compared to simple direct quenching to room temperature of a lower carbon steel with similar yield strength (plate F).

Further, surprisingly, despite the fact that the carbon content of specimens A to E (0.20%) is higher than the carbon content of specimen F (0.14%), the temperatures corresponding to 27J Charpy V impact energy (T27J) and 50% shear fracture (T50%) for plates A to E are distinctly lower, i.e. better, than for plate F.

According to Table 3, the temperature corresponding to 27J Charpy V impact energy (T27J) of DQP steel can be less than −50° C. by using thermomechanical rolling, i.e. using a hot rolling stage of type I 5 at temperatures below the RST.

The TMR-DQP plates in Table 3 (B, C and D) satisfy the target related to excellent Charpy V impact toughness transition temperature T27J≤−50° C., preferably ≤−80° C. and also yield strength $R_{p0.2}$ at least 960 MPa together with good total uniform elongation.

While the total elongation (A) and reduction of area to fracture (Z) vary in a narrow range, the total uniform elongation ($A_{gt}$) and the plastic uniform elongation ($A_g$) are higher at the lower quenching temperature of 320 and 270° C. than the same properties obtained at quenching temperature 340° C., as can be seen in Table 3.

According to Table 3, the total elongation of A≥8% was achieved, which is also a good value at this strength level.

According to Table 3, the total uniform elongation of $A_{gt}$≥2.7% was achieved, even $A_{gt}$≥3.5%, which is also a good value in this strength class.

It is preferred that especially in second main embodiment (referred as high-Al embodiment), the quenching stop temperature (QT) is between $M_s$ and $M_f$ temperatures and further less than 350° C. but greater than 200° C. in order to achieve improved properties related to elongation.

The mechanical properties obtained in the invention are better than those obtained in conventionally quenched and tempered steels in the same strength class. Further, it must be noticed that the overall combination of mechanical properties is good, including strength, ductility and impact toughness properties. All these are obtained simultaneously, and without additional heating from temperatures below $M_f$ after quenching.

Test Conditions of the Experiments

For tensile testing, according to standard EN 10002, round specimens with threaded ends (10 mm×M10 threads) and dimensions of 6 mm diameter and total parallel length of 40 mm were machined in the transverse direction to the rolling direction.

For testing impact toughness, according to standard EN 10045-1, Charpy V impact specimens (10×10×55 mm; 2 mm deep notch along transverse normal direction with root radius of 0.25±0.025 mm) were machined in the longitudinal direction, i.e. parallel to the rolling direction.

In the above, the invention has been illustrated by specific examples. It is to be noted, however, that the details of the invention may be implemented in many other ways within the scope of the accompanying claims.

The invention claimed is:

1. A method for manufacturing a high-strength structural steel comprising the following:

a providing step for providing a steel slab, a heating step for heating said steel slab to a temperature in the range 950 to 1300° C., a temperature equalizing step for equalizing the temperature of the steel slab, a hot rolling step including a hot rolling stage of type I for hot rolling said steel slab in the no-recrystallization temperature range below the recrystallization stop temperature (RST) but above the ferrite formation temperature $A_3$, a quenching step for quenching the hot-rolled steel at cooling rate of at least 20° C./s to a quenching-stop temperature (QT), which quenching-stop temperature (QT) is between $M_s$ and $M_f$ temperatures, a partitioning treatment step for partitioning the hot-rolled steel in order to transfer carbon from martensite to austenite, and a cooling step for cooling the hot-rolled steel to room temperature by forced or natural cooling.

2. The method according to claim 1, characterized in that the heating step for heating said steel slab to a temperature in the range 950 to 1300° C. includes heating said steel slab to a temperature in the range 1000 to 1300° C., in that the hot rolling step includes a hot rolling stage of type II for hot rolling said steel slab in the recrystallization temperature range above the recrystallization limit temperature (RLT), and in that the hot rolling stage of type II is performed before the hot rolling stage of type I.

3. The method according to claim 2, characterized in that the hot rolling step includes a waiting period including a hot rolling stage of type III for hot rolling said steel slab in the temperature range below the recrystallization limit temperature (RLT) and above the recrystallization stop temperature (RST), and in that the waiting period is performed after the hot rolling stage of type II and before the hot rolling stage of type I.

4. The method according to claim 3, characterized in that the steel slab is uninterruptedly rolled during the hot rolling stage of type I, the hot rolling stage of type II, and the hot rolling stage of type III and when shifting from hot rolling stage of type II to hot rolling stage of type III and correspondingly when shifting from hot rolling stage of type III to hot rolling stage of type I.

5. The method according to claim 1, characterized in that said quenching-stop temperature (QT) is between $M_s$ and $M_f$ temperatures such that the amount of austenite at said quenching-stop temperature (QT) immediately after quenching is, in terms of volume percentages, a minimum of 5% but no higher than 30%.

6. The method according to claim 1, characterized in that said partitioning treatment step is realized substantially at quenching stop temperature (QT).

7. The method according to claim 1, characterized in that said partitioning treatment step is realized substantially above quenching stop temperature (QT).

8. The method according claim 1, characterized in that said partitioning treatment step is realized at temperature in the range 250 to 500° C.

9. The method according to claim 1, characterized in that said partitioning treatment step is realized so that the average cooling rate during partitioning treatment step is less than the average cooling rate in free air cooling at the temperature concerned.

10. The method according to claim 1, characterized in that said partitioning treatment step is realized so that the maximum average cooling rate during the partitioning treatment is 0.2° C./s.

11. The method according to claim 1, characterized in that said partitioning treatment step is realized by holding at an essentially constant temperature.

12. The method according to claim 1, characterized in that said partitioning treatment step is realized within the time period 10 to 100000 s calculated from the quenching stop temperature (QT).

13. The method according to claim 1, characterized in that the method comprises a coiling step that is performed after the quenching step and before the partitioning treatment step.

14. The method according to claim 1, characterized in that said hot rolling of type I includes at least 0.4 total accumulated equivalent strain below the recrystallization stop temperature (RST).

15. The method according to claim 1, characterized in that quenching stop temperature (QT) is between the $M_s$ and $M_f$ temperatures and further below 400° C. but above 200° C. in order to achieve improved properties related to elongation.

16. The method according to claim 15, characterized in that quenching stop temperature (QT) is between the $M_s$ and $M_f$ temperatures and further below 300° C. but above 200° C. in order to achieve improved properties related to elongation.

17. The method according to claim 1, characterized in that the method comprises a prestraining step, which is performed subsequent to the partitioning treatment step.

18. The method according to claim 1, characterized in that the providing step includes providing a steel slab including Fe and unavoidable impurities, and further, in terms of mass percentages, at least the following C: 0.17 to 0.23%, Si: 1.4 to 2.0% or Si+Al: 1.2 to 2.0%, where Si is at least 0.4% and Al is at least 0.1%, Mn: 1.4 to 2.3%, and Cr: 0.4 to 2.0%.

19. The method according to claim 18, characterized in that said providing step includes providing a steel slab including Fe and unavoidable impurities, and further, in terms of mass percentages, at least the following C: 0.17 to 0.23%, Si: 1.4 to 2.0%, Mn: 1.4 to 2.3%, and Cr: 0.4 to 2.0%.

20. The method according to claim 18, characterized in that the providing step includes providing a steel slab including Fe and unavoidable impurities, and further, in terms of mass percentages, at least the following C: 0.17 to 0.23%, Si+Al: 1.2 to 2.0%, where Si is at least 0.4% and Al is at least 0.1%, Mn: 1.4 to 2.3%, Cr: 0.4 to 2.0%, and Mo: 0 to 0.7%,.

21. The method according to claim 18, characterized in that the providing step includes providing a steel slab including Fe and unavoidable impurities, and further, in terms of mass percentages, at least the following C: 0.17 to 0.23%, Si+Al: 1.2 to 2.0%, where Si is 0.4 to 1.2% and where Al is 0.8 to 1.6%, Mn: 1.4 to 2.3%, Cr: 0.4 to 2.0%, and Mo: 0 to 0.7%,.

22. The method according to claim 18, characterized in that said providing step includes providing a steel slab including Fe and unavoidable impurities, and further, in terms of mass percentages, at least the following C: 0.17 to 0.23%, Si+Al: 1.2 to 2.0%, where Si is 0.4 to 0.7% and where Al is 0.8 to 1.3%, Mn: 1.8 to 2.3%, Cr: 0.4 to 2.0%, and Mo: 0 to 0.7%.

23. The method according to claim 18, characterized in that said hot rolling step is realized so that the final thickness of the hot-rolled steel plate or sheet is 3 to 20 mm and in that the hardenability index DI as calculated utilizing the formula $$DI=13.0Cx(1.15+2.48Mn+0.74Mn^2)\times(1+2.16Cr)\times(1+3.00Mo)\times(1+1.73V)\times(1+0.36Ni)\times(1+0.70Si)\times(1+0.37Cu)$$

is more than 70 mm.

24. The method according to claim 18, characterized in that said hot rolling step is realized so that the final thickness of the hot-rolled steel plate or sheet is 3 to 20 mm and in that the hardenability index DI as calculated utilizing the formula $$DI=13.0Cx(1.15+2.48Mn^2)\times(1+2.16Cr)\times(1+3.00Mo)\times(1+1.73V)\times(1+0.36Ni)\times(1+0.70Si)\times(1+0.37Cu)$$

is at least 125 mm.

25. A high-strength structural steel product having yield strength $R_{p0.2}\geq 960$ MPa, having a microstructure comprising, in terms of volume percentages, at least 80% martensite and 5 to 20% retained austenite, characterized in that said martensite consists of fine martensitic laths, shortened and randomized in different directions, and wherein the steel product is substantially free of iron carbides.

26. The high-strength structural steel product according to claim 25, characterized in that the high-strength structural steel product is substantially free of carbides formed after fcc (face-centered cubid) to bcc (body-centered cubid) transformation.

27. The high-strength structural steel product according to claim 25, characterized in that the high-strength structural steel product has a Charpy V 27J transition temperature of less than −50° C.

28. The high-strength structural steel product according to claim 25, characterized in that high-strength structural steel product includes, in terms of mass percentages, Fe and unavoidable impurities, and further includes at least the following C: 0.17 to 0.23%, Si: 1.4 to 2.0% or Si+Al: 1.2 to 2.0%, where Si is at least 0.4% and where Al is at least 0.1%, Mn: 1.4 to 2.3%, and Cr: 0.4 to 2.0%.

29. The high-strength structural steel product according to claim 28, characterized in that the high-strength structural steel product includes, in terms of mass percentages, Fe and unavoidable impurities, and further includes at least the following C: 0.17 to 0.23%, Si: 1.4 to 2.0%, Mn: 1.4 to 2.3%, and Cr: 0.4 to 2.0%.

30. The high-strength structural steel product according to claim 28, characterized in that the high-strength structural steel product includes, in terms of mass percentages, Fe and unavoidable impurities, and includes further at least the following C: 0.17 to 0.23%, Si+Al: 1.2 to 2.0%, where Si is at least 0.4% and where Al is at least 0.1%, Mn: 1.4 to 2.3%, Cr: 0.4 to 2.0%, and Mo: 0 to 0.7%.

31. The high-strength structural steel product according to claim 28, characterized in that the high-strength structural steel product includes, in terms of mass percentages, Fe and unavoidable impurities, and includes further at least the following C: 0.17 to 0.23%, Si+Al: 1.2 to 2.0%, where Si is 0.4 to 1.2% and where Al is 0.8 to 1.6%, Mn: 1.4 to 2.3%, Cr: 0.4 to 2.0%, and Mo: 0 to 0.7%.

32. The high-strength structural steel product according to claim 28, characterized in that the high-strength structural steel product includes, in terms of mass percentages, Fe and unavoidable impurities, and includes further at least the following C: 0.17 to 0.23%, Si+Al: 1.2 to 2.0%, where Si is 0.4 to 0.7% and where Al is 0.8 to 1.3%, Mn: 1.4 to 2.3%, Cr: 0.4 to 2.0%, and Mo: 0 to 0.7%.

33. The high-strength structural steel product according to claim 28, characterized in that the high-strength structural steel product has thickness of 3 to 20 mm and in that the hardenability index DI as calculated utilizing the formula $$DI=13.0Cx(1.15+2.48Mn+0.74Mn^2)\times(1+2.16Cr)\times(1+3.00Mo)\times(1+1.73V)\times(1+0.36Ni)\times(1+0.70Si)\times(1+0.37Cu)$$

is more than 70 mm.

34. The high-strength structural steel product according to claim 28, characterized in that the high-strength structural steel product having thickness of 3 to 20 mm and in that the hardenability index DI as calculated utilizing the formula $$DI=13.0Cx(1.15+2.48Mn+0.74Mn^2)\times(1+2.16Cr)\times(1+3.00Mo)\times(1+1.73V)\times(1+0.36Ni)\times(1+0.70Si)\times(1+0.37Cu)$$

is at least 125 mm.

35. The high-strength structural steel product according to claim 25, characterized in that the total elongation to fracture (A) of high-strength structural steel product is A≥8% and/or total uniform elongation ($A_{gt}$) of high-strength structural steel product is $A_{gt}$≥2.7%.

36. The high-strength structural steel product according to claim 29, characterized in that the total elongation to fracture (A) of high-strength structural steel product is A≥10% and/or total uniform elongation ($A_{gt}$) of high-strength structural steel product is $A_{gt}$≥3.5%.

37. The high-strength structural steel product according to claim 25, characterized in that said yield strength of high-strength structural steel product is $R_{p0.2}$≥1200 MPa.

38. The high-strength structural steel product of claim 25, wherein the steel product comprises a yields strength $R_{p0.2}$≥1000 MPa.

39. The high-strength structural steel product of claim 25, wherein the steel product is substantially free of iron carbides and cementite.

* * * * *